US008834131B2

(12) United States Patent
Kawashima et al.

(10) Patent No.: US 8,834,131 B2
(45) Date of Patent: Sep. 16, 2014

(54) MOTOR-DRIVEN COMPRESSOR AND CONTROLLER THEREFOR

(75) Inventors: Takashi Kawashima, Kariya (JP); Kazuki Najima, Kariya (JP); Fumihiro Kagawa, Kariya (JP); Motonobu Funato, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 533 days.

(21) Appl. No.: 13/279,933

(22) Filed: Oct. 24, 2011

(65) Prior Publication Data

US 2012/0107141 A1 May 3, 2012

(30) Foreign Application Priority Data

Oct. 27, 2010 (JP) ..... 2010-240911

(51) Int. Cl.

| | |
|---|---|
| ***F04B 39/02*** | (2006.01) |
| ***F04B 49/02*** | (2006.01) |
| ***F04B 35/04*** | (2006.01) |
| ***F04C 29/02*** | (2006.01) |
| ***F04C 14/00*** | (2006.01) |
| ***F04C 28/06*** | (2006.01) |
| ***F04C 23/00*** | (2006.01) |
| ***F04B 39/06*** | (2006.01) |
| ***F04B 49/06*** | (2006.01) |
| *F04C 18/02* | (2006.01) |

(52) U.S. Cl.

CPC ..... *F04C 28/06* (2013.01); *F04C 18/0215* (2013.01); *F04C 23/008* (2013.01); *F04C 2270/86* (2013.01); *F04B 39/06* (2013.01); *F04C 2270/24* (2013.01); *F04B 49/065* (2013.01); *F04C 2240/403* (2013.01); *F04B 35/04* (2013.01); *F04C 2270/46* (2013.01); *F04B 49/02* (2013.01); *F04C 2270/701* (2013.01)

USPC ..... 417/45

(58) Field of Classification Search

CPC ..... F04B 49/106; F04B 49/04; F04B 49/06; F04B 49/065; F04B 49/20; F04B 39/023; F04B 9/023; F04C 23/008; F04C 28/06; F04C 2270/24; F04C 2270/701; F04C 2270/86; F04C 2270/46; F04C 2240/403

USPC ..... 417/36, 45, 63, 902

See application file for complete search history.

(56) References Cited

U.S. PATENT DOCUMENTS 6,640,564 B2 11/2003 Yamashita et al.
7,568,894 B2 * 8/2009 Uratani ..... 417/63

(Continued)

FOREIGN PATENT DOCUMENTS

CN 1447881 A 10/2003
JP 59-160081 A 9/1984

(Continued)

OTHER PUBLICATIONS

International Search Report dated Apr. 18, 2012 issued in European Patent Application No. 11186341.1.

(Continued)

*Primary Examiner* — Bryan Lettman

(74) *Attorney, Agent, or Firm* — Sughrue Mion, PLLC

(57) ABSTRACT

A motor controller for a motor-driven compressor includes a compressing body for compressing and discharging a refrigerant and a motor including a rotary shaft, the motor for driving the compressing body through the rotary shaft. A coil of the motor is arranged in a refrigerant containing area in the motor-driven compressor. The motor controller includes a determining section for determining whether liquid refrigerant is present in the refrigerant containing area and a modulation control section for driving the motor in accordance with three phase modulation control or two phase modulation control based on a determination result of the determining section.

10 Claims, 4 Drawing Sheets

(56) References Cited

U.S. PATENT DOCUMENTS

| | | | | |
|---|---|---|---|---|
| 2003/0106331 | A1 | 6/2003 | Yamashita et al. | |
| 2003/0180151 | A1 | 9/2003 | Jeun | |
| 2005/0254977 | A1* | 11/2005 | Aya et al. | 417/437 |
| 2006/0018763 | A1* | 1/2006 | Uratani | 417/32 |
| 2006/0039807 | A1 | 2/2006 | Hamaoka et al. | |
| 2010/0178175 | A1 | 7/2010 | Koyama | |

FOREIGN PATENT DOCUMENTS

| | | | |
|---|---|---|---|
| JP | 62-23587 | A | 1/1987 |
| JP | 8-200231 | A | 8/1996 |
| JP | 2000-324876 | A | 11/2000 |
| JP | 2002-322984 | A | 11/2002 |
| JP | 2007-166766 | A | 6/2007 |
| JP | 2008-298010 | A | 12/2008 |
| JP | 2009-250123 | A | 10/2009 |
| JP | 2009-264903 | A | 11/2009 |

OTHER PUBLICATIONS

Chinese Office Action for corresponding CN Patent Application No. 201110329978.9 issued on Nov. 29, 2013. Yes.

* cited by examiner

MOTOR-DRIVEN COMPRESSOR AND CONTROLLER THEREFOR

BACKGROUND

The present disclosure relates to a motor controller for motor-driven compressor. The motor-driven compressor has a motor and a compressing body. The motor-driven compressor compresses and discharges refrigerant.

To cool the motor, this type of motor-driven compressor has the coil of the motor in an area where drawn refrigerant exists (see, for example, Japanese Laid-Open Patent Publication No. 2009-250123). If the motor is in a stopped state for a long time, the refrigerant liquefies in the area where the coil is mounted, and the coil is exposed to accumulated liquid refrigerant. Accordingly, when the motor is started, the coil may experience an electric leak as a result of the exposure of the coil to liquid refrigerant. Particularly, when the voltage supplied to the coil varies to a great extent, such an electric leak is more likely to occur.

An inverter is employed to control operation of the motor. The disclosure described in the aforementioned document uses a transformer circuit for transforming the voltage supplied to the inverter. The transformer circuit is controlled by a voltage control section. The voltage control section controls the transformer circuit to supply a low voltage to the inverter when liquid refrigerant is accumulated in the housing. When it is determined that liquid refrigerant has not accumulated in the housing, the voltage control section switches from a low voltage to a high voltage. The disclosure of the aforementioned document aims to, through such voltage control, prevent an electric leak by lowering the voltage when liquid refrigerant is accumulated in the area in which the coil is arranged.

Controls performed on inverters include a three phase modulation control and a two phase modulation control. The two phase modulation control has the advantage that loss of the inverter (switching loss of the inverter) is relatively low compared to the three phase modulation control.

However, the two phase modulation control is achieved by varying the voltage of the motor at the neutral point in the three phase modulation control. Accordingly, if liquid refrigerant is accumulated in the housing and thus the stray capacitance between the housing and the coil is lowered, an electric leak is more likely to occur in the two phase modulation control than in the three phase modulation control.

Accordingly, it is an objective of the present to reduce loss of the inverter in a motor-driven compressor and decrease the likelihood of an electric leak.

SUMMARY

To achieve the foregoing objective and in accordance with the present disclosure, a motor controller for a motor-driven compressor is provided. The motor-driven compressor includes a compressing body for compressing and discharging a refrigerant and a motor including a rotary shaft, the motor for driving the compressing body through the rotary shaft. A coil of the motor is arranged in a refrigerant containing area in the motor-driven compressor. The motor controller includes a determining section and a modulation control section. The determining section determines whether liquid refrigerant is present in the refrigerant containing area. The modulation control section drives the motor in accordance with a three phase modulation control or a two phase modulation control based on a determination result of the determining section.

Other aspects and advantages of the disclosure will become apparent from the following description, taken in conjunction with the accompanying drawings, illustrating by way of example the principles of the disclosure.

BRIEF DESCRIPTION OF THE DRAWINGS

The features of the present disclosure that are believed to be novel are set forth with particularity in the appended claims. The disclosure, together with objects and advantages thereof, may best be understood by reference to the following description of the presently preferred embodiments together with the accompanying drawings in which:

FIG. 2(*b*) is a graph representing three phase modulation control on the inverter shown in FIG. 2(*a*);

FIG. 2(*c*) is a graph representing two phase modulation control on the inverter shown in FIG. 2(*a*);

DESCRIPTION OF THE PREFERRED EMBODIMENTS

Figure 1:
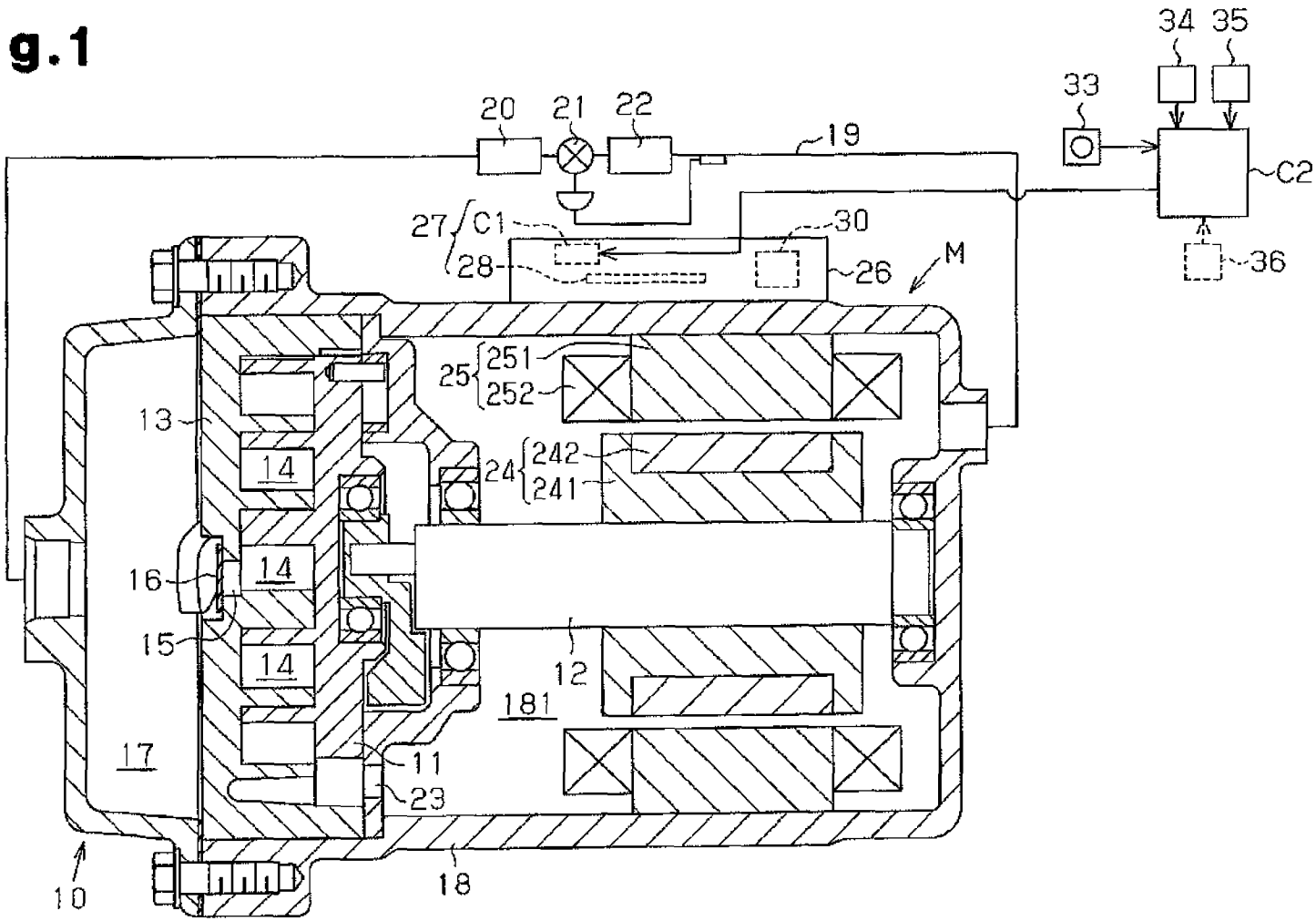
FIG. 1 is a cross-sectional side view showing a motor-driven compressor according to a first embodiment of the present disclosure as a whole.
Figure 2A:
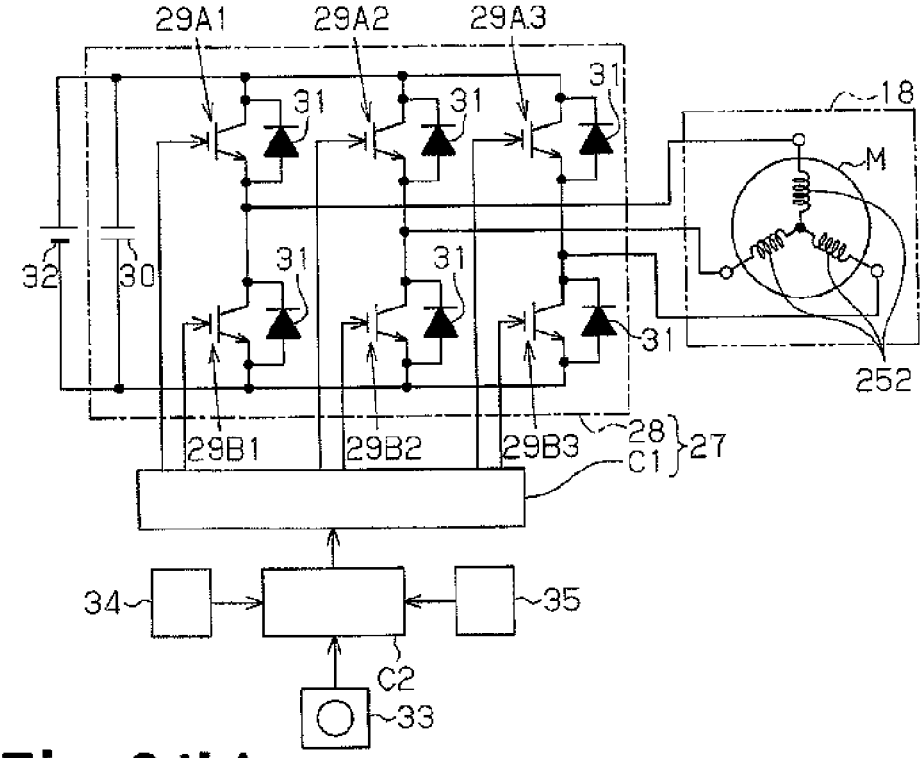
FIG. 2(*a*) is a circuit diagram representing the inverter illustrated in FIG. 1.
Figure 2B:
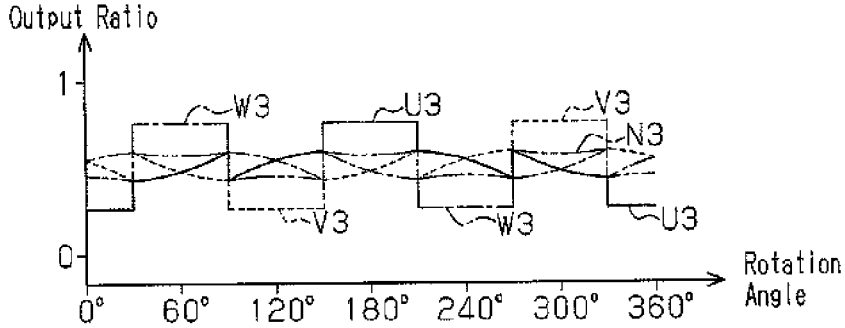
Figure 2C:
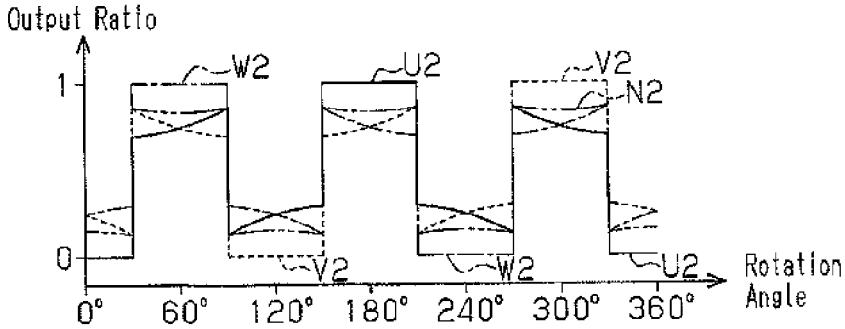
Figure 3:
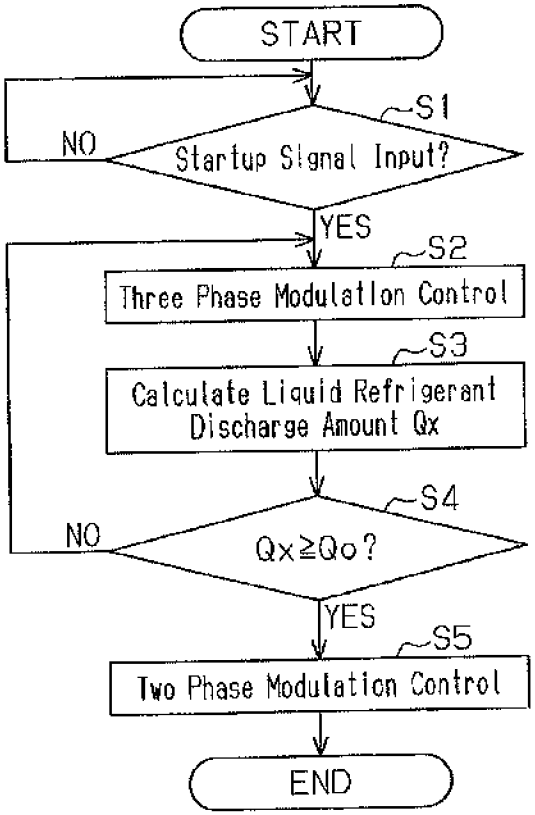
FIG. 3 is a flowchart representing a phase modulation control program.

FIGS. 1 to 3 illustrate a first embodiment of a scroll type motor-driven compressor according to the present disclosure.

A movable scroll 11, which is a component of a scroll type motor-driven compressor 10, is rotated through rotation of a rotary shaft 12 constituting a motor M. This reduces the volume of a compression chamber 14. The compression chamber 14 is defined between the movable scroll 11, which serves as a compressing body, and a fixed scroll 13. Refrigerant in the compression chamber 14 thus flows into a discharge chamber 17 through a discharge port 15 by pushing a discharge valve 16 open.

The discharge chamber 17 and a suction chamber 181 in a motor housing 18 communicate with each other through an external refrigerant circuit 19. A heat exchanger 20 for removing heat from the refrigerant, an expansion valve 21, and a heat exchanger 22 for transmitting ambient heat to the refrigerant are arranged in the external refrigerant circuit 19. The refrigerant in the discharge chamber 17 flows into the external refrigerant circuit 19. After passing through the external refrigerant circuit 19, the refrigerant returns to the suction chamber 181. The refrigerant is thus sent from the suction chamber 181 to the compression chamber 14 via a suction port 23. The suction chamber 181 corresponds to a refrigerant containing area in the motor-driven compressor 10.

The motor M is configured by a rotor 24 and a stator 25. The rotor 24 is secured to the rotary shaft 12. The stator 25 is fixed to the inner peripheral surface of the motor housing 18. The rotor 24 is formed by a rotor core 241 secured to the rotary shaft 12 and a plurality of permanent magnets 242, which are arranged on a circumferential surface of the rotor core 241. Each adjacent pair of the permanent magnets 242 in the circumferential direction of the rotor core 241 has mutually different magnet poles at the side facing the stator 25.

The stator 25 is formed by an annular stator core 251 and coils 252 wound around the stator core 251. The rotor 24 is rotated when the power is supplied to the coils 252. The rotary shaft 12 rotates integrally with the rotor 24. The coils 252 of the motor M are arranged in the refrigerant containing area (the suction chamber 181) in the motor-driven compressor 10.

An inverter housing 26 is mounted at the outer peripheral surface of the motor housing 18. The inverter housing 26 accommodates an inverter 27. The coils 252 receive power through the inverter 27.

As shown in FIG. 2(*a*), the inverter 27 is configured by a motor driver circuit 28 and a main computer C1 for controlling the motor driver circuit 28. The motor driver circuit 28 has a plurality of transistors 29A1, 29A2, 29A3, 29B1, 29B2, 29B3 and a capacitor 30 for smoothing an electric current. Diodes 31 are connected to the transistors 29A1, 29A2, 29A3, 29B1, 29B2, 29B3. The diodes 31 return the back electromotive force produced by the motor M to a DC power source 32.

The bases of the transistors 29A1, 29A2, 29A3, 29B1, 29B2, 29B3 are signal-connected to the main computer C1. The emitters of the transistors 29A1, 29A2, 29A3 are connected to the DC power source 32. The collectors of the transistors 29A1, 29A2, 29A3 are connected to the coils 252 of the motor M. The collectors of the transistors 29B1, 29B2, 29B3 are connected to the DC power source 32. The emitters of the transistors 29B1, 29B2, 29B3 are connected to the coils 252 of the motor M. The main computer C1 controls the number of revolutions of the motor M by controlling switching of the transistors 29A1, 29A2, 29A3, 29B1, 29B2, 29B3.

The graph of FIG. 2(*b*) represents an example of three phase modulation control on the motor M, and FIG. 2(*c*) represents an example of two phase modulation control on the motor M. The main computer C1 performs the phase modulation control represented by the graphs of FIGS. 2(*b*) and 2(*c*).

The waveform U3 represented by a solid line in the graph of FIG. 2(*b*) represents the proportion of the U phase output voltage with respect to the input voltage in the three phase modulation control. The waveform V3 represented by a broken line represents the proportion of the V phase output voltage with respect to the input voltage in the three phase modulation control. The waveform W3 represented by a single-dashed lines represents the proportion of the W phase output voltage with respect to the input voltage in the three phase modulation control. The waveform N3 represented by a double-dashed lines represents the proportion of the output voltage at the neutral point with respect to the input voltage in the three phase modulation control.

The waveform U2 represented by a solid line in the graph of FIG. 2(*c*) represents the proportion of the U phase output voltage with respect to the input voltage in the two phase modulation control. The waveform V2 represented by a broken line represents the proportion of the V phase output voltage with respect to the input voltage in the two phase modulation control. The waveform W2 represented by a single-dashed line represents the proportion of the W phase output voltage with respect to the input voltage in the two phase modulation control. The waveform N2 represented by a double-dashed line represents the proportion of the output voltage at the neutral point with respect to the input voltage in the two phase modulation control.

In the three phase modulation control, switching is performed for all of the transistors 29A1, 29A2, 29A3, 29B1, 29B2, 29B3 constantly around 360° of rotation of the rotor 24. In the two phase modulation control, switching of one of the transistors 29A1, 29A2, 29A3 and switching of one of the transistors 29B1, 29B2, 29B3 are stopped every 60° of rotation of the rotor 24. In other words, switching is stopped alternately for the three phases one by one, with switching for the other two phases maintained continually. Accordingly, the two phase modulation control exhibits small loss of the inverter compared to the three phase modulation control. Also, as is clear from the graphs of FIGS. 2(*b*) and 2(*c*), the voltage fluctuation at the neutral point in the two phase modulation control is greater than the voltage fluctuation at the neutral point in the three phase modulation control.

As illustrated in FIG. 2(*a*), a sub computer C2 is signal-connected to the main computer C1. An air conditioner switch 33, an indoor temperature detector 34, and an indoor temperature setting device 35 are signal-connected to the sub computer C2. When the air conditioner switch 33 is ON, the sub computer C2 provides the main computer C1 with a designated number of revolutions Nx, which corresponds to the information regarding the difference (Θo−Θx) between a target indoor temperature Θo set through the indoor temperature setting device 35 and a detected indoor temperature Θx detected by the indoor temperature detector 34. The designated number of revolutions Nx is a number of revolutions that is set in such a manner as to cause the detected indoor temperature Θx to reach the target indoor temperature Θo.

FIG. 3 is a flowchart representing a phase modulation control program for the coils 252 of the motor M. The main computer C1 carries out the phase modulation control represented by the flowchart of FIG. 3. The phase modulation control by the main computer C1 will hereafter be described.

The main computer C1 stands by until a startup command is input in response to activation of the air conditioner switch 33 (Step S1). When a startup command is input (YES in Step S1), the main computer C1 performs the three phase modulation control represented by the graph of FIG. 2(*b*) (Step S2). The main computer C1 calculates (estimates) the discharge amount of liquid refrigerant sent out from the suction chamber 181 in the motor housing 18 after the point in time when the motor M is started, which is the liquid refrigerant discharge amount Qx (Step S3). The liquid refrigerant discharge amount Qx is calculated (estimated) using a prescribed expression in which the designated number of revolutions Nx is a variable number and the displacement is a constant number. The designated number of revolutions Nx is the number of revolutions of the motor-driven compressor 10.

The main computer C1 determines whether the calculated liquid refrigerant discharge amount Qx is greater than or equal to a preset reference amount Qo, which is a predetermined value (Step S4). When the liquid refrigerant discharge amount Qx is less than the reference amount Qo (Qx<Qo, or NO in Step S4, indicating that liquid refrigerant is present), the main computer C1 continues the three phase modulation control. Since the voltage fluctuation at the neutral point in the three phase modulation control is small, the likelihood of an electric leak decreases even though liquid refrigerant is present in the suction chamber 181 in the motor housing 18.

If the liquid refrigerant discharge amount Qx is greater than or equal to the reference amount Qo, which is predetermined, (Qx≥Qo, or YES in Step S4, indicating that liquid refrigerant is not present), the main computer C1 switches from the three phase modulation control to the two phase modulation control represented by FIG. 2(*c*) (Step S5). The reference amount Qo is a value that is not less than the maximum amount of liquid refrigerant retainable in the suction chamber 181 in the motor housing 18. In other words, the reference amount Qo is an amount that indicates that the suction chamber 181 does not retain liquid refrigerant when the calculated liquid refrigerant discharge amount Qx reaches the reference amount Qo.

The main computer C1 is a determining section that determines whether liquid refrigerant is present in the refrigerant containing area (181). The inverter 27 is a modulation control section that operates the motor M in accordance with the three phase modulation control when the main computer C1 determines that liquid refrigerant is present in the refrigerant containing area. The modulation control section operates the motor M in accordance with the two phase modulation control when it is determined that liquid refrigerant is not present in the refrigerant containing area.

The first embodiment has the advantages described below.

(1) When the main computer C1 determines that liquid refrigerant is present in the refrigerant containing area (181), the three phase modulation control is performed on the motor M and the voltage fluctuation at the neutral point is decreased. As a result, an electric leak when liquid refrigerant is present in the suction chamber 181 is avoided. In contrast, when the main computer C1 determines that liquid refrigerant is not present in the refrigerant containing area (181), the two phase modulation control is carried out on the motor M, and the loss of the inverter 27 is reduced.

In this configuration, the control of the motor M is switched between the three phase modulation control and the two phase modulation control depending on whether liquid refrigerant is present in the suction chamber 181. This reduces the loss of the inverter and lowers the likelihood of an electric leak.

(2) When the motor M is started, the motor M is subjected to the three phase modulation control. Accordingly, even if liquid refrigerant accumulated in the refrigerant containing area before the motor M is started, the likelihood of an electric leak is decreased.

(3) When the motor M is in operation, the main computer C1 determines whether a state in which liquid refrigerant is present in the refrigerant containing area (181) has changed to a state in which liquid refrigerant is no longer present in the refrigerant containing area (181) (Step S4). When it is determined such a change has occurred, the three phase modulation control is switched to the two phase modulation control. In order to reliably determine whether liquid refrigerant is present when power is supplied to the motor M, it is preferable to determine whether liquid refrigerant is present when the motor M is in operation.

(4) Although the displacement of the motor-driven compressor 10 of the first embodiment is constant, the number of revolutions (the designated number of revolutions Nx) varies. As the number of revolutions of the motor-driven compressor 10 rises, the discharge amount of liquid refrigerant per unit time increases. The discharge amount of liquid refrigerant from the suction chamber 181 per unit time is estimated with high accuracy based on the displacement and the number of revolutions. This improves accuracy in determining whether the discharge of settled liquid refrigerant has been completed and thus shortens the period during which the three phase modulation control is in effect before changing to the two phase modulation control. The loss of the inverter 27 is thus decreased.

Figure 4:
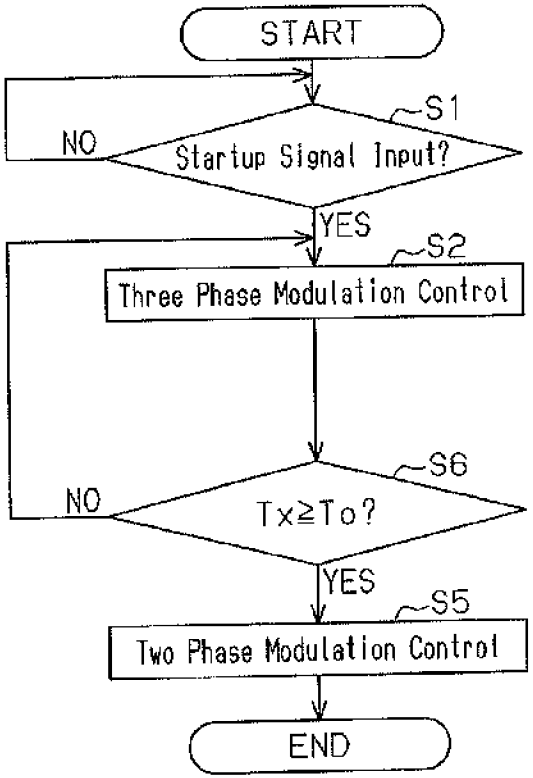
FIG. 4 is a flowchart representing a second embodiment of the disclosure.

FIG. 4 is a flowchart representing a second embodiment. The device of the second embodiment is configured identically with the device of the first embodiment. Same or like reference numerals are given to control steps in the flowchart of FIG. 4 that are the same as or like corresponding control steps in the flowchart of the first embodiment. Detailed description of these steps will be omitted herein.

After Step S2 is started, the main computer C1 measures the elapsed time Tx that has elapsed since startup of the motor M, and compares the length of the elapsed time Tx with the length of a predetermined time To, which is a predetermined value (Step S6). When the elapsed time Tx is less than the predetermined time To (NO in Step S6, and it is determined that liquid refrigerant is present), the main computer C1 continues the three phase modulation control. If the elapsed time Tx is greater than or equal to the predetermined time To (YES in Step S6, and it is determined that liquid refrigerant is not present), the main computer C1 switches from the three phase modulation control to the two phase modulation control (Step S5). The predetermined time To has been determined to be a period (which is, for example, three seconds) after which it can be estimated that liquid refrigerant is not present in the suction chamber 181.

The second embodiment has advantages that are the same as the advantages (1) to (3) of the first embodiment.

In this configuration, as long as the predetermined value (the predetermined time) is set to an adequate value, the inverter 27 is allowed to switch from the three phase modulation control to the two phase modulation control when liquid refrigerant is not present in the suction chamber 181.

Figure 5:
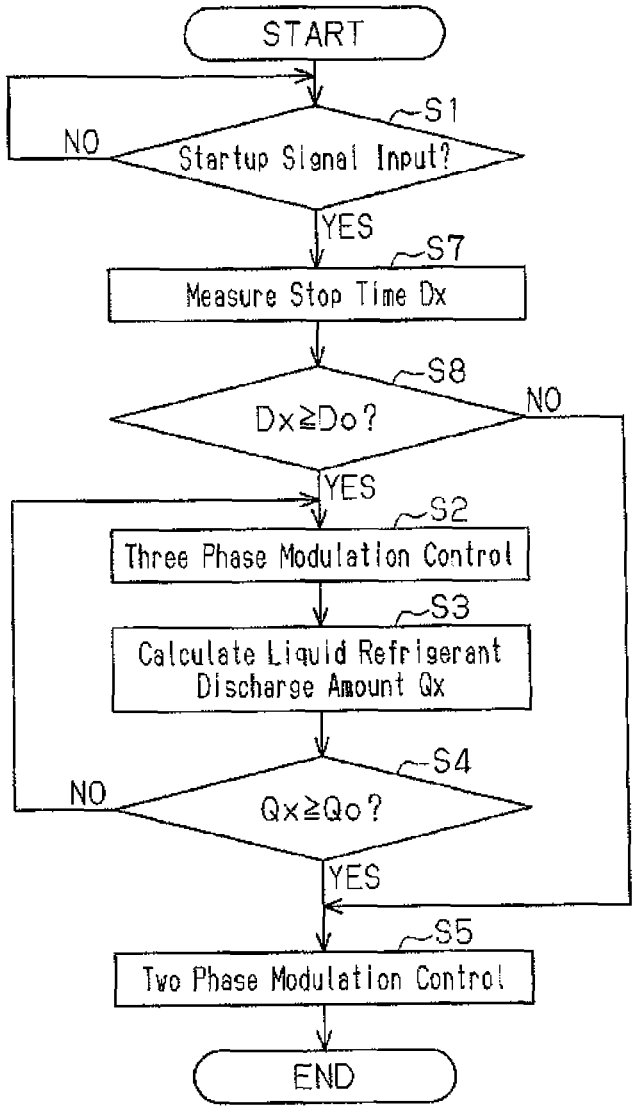
FIG. 5 is a flowchart representing a third embodiment of the disclosure.

FIG. 5 is a flowchart representing a third embodiment. The device of the third embodiment is configured identically with the device of the first embodiment. Same or like reference numerals are given to control steps in the flowchart of FIG. 5 that are the same as or like corresponding control steps in the flowchart of the first embodiment. Detailed description of these steps will be omitted herein.

When an startup command is input (YES in Step S1), the main computer C1 measures the time (the stop time) Dx in which the motor M has been maintained as stopped (Step S7). The main computer C1 compares the length of the measured stop time Dx with the length of a reference time Do that has been set in advance (Step S8). When the stop time Dx is greater than or equal to the reference time Do (YES in Step S8) it is determined that liquid refrigerant is present, and the main computer C1 performs the three phase modulation control (Step S2).

If the measured stop time Dx is less than the preset reference time Do (NO in Step S8), it is determined that liquid refrigerant is not present, and the main computer C1 performs the two phase modulation control. The reference time Do is the minimum time that allows for accumulation of liquid refrigerant in the suction chamber 181 after the motor M is stopped.

In the third embodiment, at the time a startup command is input, it is determined whether accumulated liquid refrigerant is present. If accumulated liquid refrigerant is not present in the refrigerant containing area (181) when the motor M is started, the two phase modulation control is initially employed. As a result, when liquid refrigerant is not present in the refrigerant containing area (181) when the motor M is started, the two phase modulation control is initially performed, which reduces the loss of the inverter from the time when the motor is started.

The present disclosure may be embodied in the forms described below.

The stop time of the motor M may be measured. In this case, the predetermined value (the reference amount Qo or the predetermined time To) is set based on the measured stop time. The shorter the stop time of the motor M, the smaller the amount of liquid refrigerant that is accumulated in the suction chamber 181. As a result, by measuring the stop time, the period for the three phase modulation control is minimized correspondingly before the control is switched to the two phase modulation control.

The actual start time of the motor M may be delayed from the time point at which the startup command is input. In this case, determination of whether liquid refrigerant is present is carried out during the delay time.

A temperature detector 36 (shown in FIG. 1 with dashed line) serving as a temperature detecting section may be employed to detect the temperature in the motor housing 18 or the suction chamber 181. In this case, the main computer C1 changes the predetermined value (the reference value Qo or the predetermined time To) in accordance with the temperature detected by the temperature detector. The reference value Qo or the predetermined time To is the reference in accordance with which the main computer C1 determines whether liquid refrigerant is present in the refrigerant containing area (181). The higher the temperature detected by the temperature detector, the smaller the amount of liquid refrigerant accumulated in the suction chamber 181. By using information about the temperature in determination whether discharge of liquid refrigerant has been completed, the accuracy for such determination is improved. This correspondingly shortens the period for the three phase modulation control before the control is switched to the two phase modulation control.

As the aforementioned temperature detector, a temperature detector for detecting the temperature in the inverter 27 may be employed. In this case, information about the temperature detected by the temperature detector is used mainly to avoid overheating in the inverter 27.

The main computer C1 may be configured to determine whether liquid refrigerant is present in the suction chamber 181 at a time when the motor M is started.

In this configuration, if liquid refrigerant is not present in the suction chamber 181 when the motor M is started, the two phase modulation control is employed. This allows the inverter 27 to reduce the loss of the inverter in the motor-driven compressor 10 from the time when the motor M is started.

The present disclosure may be used in an electric motor having a number of revolutions different from the number of revolutions of a motor.

The disclosure may be employed in a piston type motor-driven compressor.

The disclosure is usable in a variable displacement type motor-driven compressor.

The invention claimed is:

1. A motor controller for a motor-driven compressor, the motor-driven compressor including a compressing body for compressing and discharging a refrigerant and a motor including a rotary shaft, the motor for driving the compressing body through the rotary shaft, wherein a coil of the motor is arranged in a refrigerant containing area in the motor-driven compressor, and wherein the motor controller comprises:

a determining section for determining whether liquid refrigerant is present in the refrigerant containing area; and a modulation control section for driving the motor in accordance with a three phase modulation control or a two phase modulation control based on a determination result of the determining section.

2. The motor controller according to claim 1, wherein the modulation control section drives the motor in accordance with the three phase modulation control in the period from a time when the motor is started to a time when the determining section determines whether liquid refrigerant is present in the refrigerant containing area.

3. The motor controller according to claim 1, wherein the determining section is configured to determine whether liquid refrigerant is present in the refrigerant containing area at a time when the motor is started.

4. The motor controller according to claim 1, wherein the determining section is configured to determine whether liquid refrigerant is present in the refrigerant containing area when the motor is in operation.

5. The motor controller according to claim 1, wherein the modulation control section is configured to drive the motor in accordance with the two phase modulation control when the determining section determines that liquid refrigerant is not present in the refrigerant containing area, and the modulation control section is configured to drive the motor in accordance with the three phase modulation control when the determining section determines that liquid refrigerant is present in the refrigerant containing area.

6. The motor controller according to claim 1, wherein the determining section is configured to estimate the amount of liquid refrigerant discharged by the motor-driven compressor based on the displacement and the number of revolutions of the motor-driven compressor, and the determining section is configured to determine that liquid refrigerant is not present in the refrigerant containing area if the amount of the discharged liquid refrigerant reaches a predetermined value.

7. The motor controller according to claim 6, wherein the determining section is configured to measure a stop time of the motor, and the determining section is configured to set the predetermined value based on the stop time.

8. The motor controller according to claim 1, wherein the determining section is configured to measure an elapsed time that has elapsed from the time the motor is started, and the determining section is configured to determine that liquid refrigerant is not present in the refrigerant containing area when the elapsed time reaches a predetermined value.

9. The motor controller according to claim 1, wherein the modulation control section is an inverter, the motor-driven compressor further includes a temperature detecting section for detecting the temperature of the inverter, and the determining section changes a reference in accordance with which it is determined whether liquid refrigerant is present in the refrigerant containing area in accordance with the temperature detected by the temperature detecting section.

10. A motor-driven compressor, comprising:

a compressing body;

a motor having a coil and a rotary shaft, the motor for driving the compressing body through the rotary shaft;

a compressing chamber;

a refrigerant containing area, wherein the coil of the motor is arranged in the refrigerant containing area; and a motor controller including a determining section and a modulation control section, wherein the compressing body is adapted to compress and discharge refrigerant, wherein the determining section is adapted to determine whether liquid refrigerant is present in the refrigerant containing area, and wherein the modulation control section is adapted to drive the motor in accordance with a three phase modulation control or a two phase modulation control based on a determination result of the determining section.

* * * * *